US005526014A

United States Patent [19]

Shiba et al.

[11] Patent Number: 5,526,014

[45] Date of Patent: Jun. 11, 1996

[54] SEMICONDUCTOR DEVICE FOR DRIVING LIQUID CRYSTAL DISPLAY PANEL

[75] Inventors: Hiroshi Shiba; Sei Saitoh, both of Tokyo, Japan

[73] Assignee: NEC Corporation, Tokyo, Japan

[21] Appl. No.: 401,304

[22] Filed: Mar. 9, 1995

Related U.S. Application Data

[63] Continuation of Ser. No. 23,125, Feb. 26, 1993, abandoned.

[30] Foreign Application Priority Data

Feb. 26, 1992 [JP] Japan ..... 4-038917

[51] Int. Cl.[6] ..... G09G 3/36

[52] U.S. Cl. ..... 345/96; 345/98

[58] Field of Search ..... 345/87, 94, 96, 345/98, 100, 204, 208, 209; 359/54, 55; 348/790

[56] References Cited

U.S. PATENT DOCUMENTS

| | | | |
|---|---|---|---|
| 3,653,745 | 4/1972 | Mao | 350/160 |
| 4,842,371 | 6/1989 | Yasuda et al. | 350/333 |
| 4,926,168 | 5/1990 | Yamamoto et al. | 345/96 |
| 5,093,655 | 3/1992 | Tanioka et al. | 345/96 |
| 5,107,353 | 4/1992 | Okumura | 345/96 |

OTHER PUBLICATIONS

"MOS Integrated Circuit μPD16400", published in Mar. 1990 by NEC Corporation.

*Primary Examiner*—Richard Hjerpe

*Assistant Examiner*—Regina Liang

*Attorney, Agent, or Firm*—Sughrue, Mion, Zinn, Macpeak & Seas

[57] ABSTRACT

An improvement of the LCD driving semiconductor IC which supplies a plurality of source driving voltages (corresponding to the horizontal scanning voltage of a CRT) to a plurality of source driving lines of an active matrix type LCD of TFT base is proposed. Each of sample/hold circuit that is provided in one-to-one correspondence to the source driving lines which carry out polarity inversion and extraction of voltage sample values of an image signal for every one line of horizontal scanning of applied voltages to liquid crystal cells for the purpose of preventing the deterioration of liquid crystal cells consisting of pixel display electrodes and counter electrodes of LCD and a liquid crystal material inserted between the electrodes, is composed of complementarily operating first circuit part and second circuit part, and the correspondence relation between polarity display pulse that controls the complementary operation of these circuit parts and the polarity of the voltage sample value, and these first/second circuit parts is fixed. By so doing, the variation range of the input voltage to each buffer amplifier of the first/second circuit parts was limited, the source-drain region formation process of the input transistor of its amplifier was simplified, and facilitated the improvement of the accuracy of the source driving voltage with respect to the input image signal.

8 Claims, 5 Drawing Sheets

SEMICONDUCTOR DEVICE FOR DRIVING LIQUID CRYSTAL DISPLAY PANEL

This is a continuation of application Ser. No. 08/023,125 filed Feb. 26, 1993, now abandoned.

BACKGROUND OF THE INVENTION

1.Field of the Invention

The present invention relates to a semiconductor integrated circuit device (IC) for driving a liquid crystal display (referred to as LCD hereinafter) panel, and more particularly to a semiconductor IC adapted for driving an active matrix type LCD panel for displaying image signals such as television signals.

2. Description of the Prior Art

The use of the LCD panel started with the electronic disk computer and wrist watch, and as of now it is spreading to the color television receiver, word processor and the monitor equipment of various kinds of OA apparatus and various kinds of computer terminal. This advancement is being accelerated by the progress of the fabrication technology of the active matrix type LCD panel, particularly of the active matrix type LCD panel that makes use of the thin film transistors (referred to as TFTs hereinafter).

An LCD panel has a pair of transparent glass plates that are arranged mutually parallel maintaining an extremely narrow gap, and a liquid crystal material that is interposed in the gap. On the inner surface of one of these transparent glass plates are arranged in matrix form a large number of pixel forming electrodes (pixel electrodes), and on the inner surface of the other glass plate are arranged counter electrodes that oppose respectively to these pixed electrodes. The electrode pairs that consist of respective. ones of the pixel electrodes and respective ones of the counter electrodes form liquid crystal cells together with the liquid crystal material that is interposed between them, and desired image display is achieved by selectively controlling the light transmission characteristic of the liquid crystal cells through application of voltages to these electrode pairs.

In a TFT-base LCD which is the representative of the active matrix type LCD, there are formed a large number of row wiring members which extend mutually parallel along the row direction between the rows of the pixel electrodes of the matrix array and a large number of mutually parallel column wiring members formed between the columns along the column direction perpendicular to the row wiring members. At each of the noncontact intersections of these row wiring members and the column wiring members there is arranged a switching TFT with its gate electrode connected to the row wiring member, its source electrode connected to the column wiring member, and its drain electrode connected to the image electrode. Reflecting the connective relation to each electrode of the TFT, a row wiring member and a column wiring member will be referred to hereinafter as a gate driving line and a source driving line, respectively. The representative LCD panel for color television or personal computer monitor currently on the market has 400 gate driving lines and 640 source driving lines. A gate driving pulse train corresponding to the vertical sweep voltage in a CRT display device is supplied stepwise from a gate drive circuit to these gate driving lines. In other words, a line of large number of liquid crystal cells connected to each of these gate driving lines represents an image for one line component of horizontal scanning of the image signal.

On the other hand, the source driving lines receive, synchronized with horizontal shift pulses of horizontal scanning, from a source drive circuit the supply of a train of sample values each representing the sample value of the image signal voltage to be displayed. The source drive circuit is equipped with a shift register which has register stages equal in number to the source driving lines of the LCD, and generates in succession the horizontal shift pulse synchronized with the horizontal synchronizing pulse of the image signal, and a sample/hold circuit which has sampling circuits equal in number to the register stages for sampling an analog image signal to be displayed, in response to the horizontal shift pulse, and holds the respective sampled values.

Since it is necessary to highly integrate the gate drive circuit and the source drive circuit corresponding to the high density arrangement of the gate driving lines and the source driving lines on the LCD panel, they are put on the market each in the form of a semiconductor IC. As for the LCD for color television signal display a panel drive circuit is normally formed by combining a gate driving IC and a source driving IC.

The plurality of sample/hold circuits constitutes a buffer for applying the sampled values of the amplitude the input image signal to liquid crystal cells having a large time constant, and carries out the polarity inversion of the applied signal in order to prevent the deterioration of liquid crystal cells characteristic of the LCD panel. Namely, as is disclosed in the specification of U.S. Pat. No. 3,653,745, if driving voltages of the same polarity are applied continuously to a liquid cell, electrochemical changes are generated in the pixel electrode and the counter electrode, deteriorating the sensitivity of display and the luminance. In order to prevent this it is necessary to constantly invert the polarity of the voltage applied to the liquid crystal cell. As disclosed in the specification of U.S. Pat. No. 4,842,371, in a TFT-base active matrix LCD the polarity inversion is carried out for each line of horizontal scanning, and in the combination of interlace scanning for suppressing the flickering of the screen. That is, for odd-numbered fields, image signal is supplied only to odd-numbered lines, namely, the first, third, fifth, seventh lines, and so on from the top end among the gate driving lines, and for even-numbered fields, image signal is applied only to even-numbered lines in the order of the second, fourth, sixth, eighth lines and so on. Therefore, in conformity with this regularity, liquid crystal cells belonging to respective gate driving lines undergo polarity inversion for every line of horizontal scanning.

In the LCD drive circuit disclosed in the specification of U.S. Pat. No. 4,842,371 the polarity inversion is achieved by controlling the applied voltages to the counter electrodes, so that the LCD panel drive circuit is complicated in proportion to the number of voltages for the control objects and the required driving power is accordingly high. In contrast, in the semiconductor IC for LCD driving, announced in a preliminary data sheet entitled "MOS Integrated Circuit uPD16400" published in March 1990 by NEC Corporation which is the assignee of this invention, a configuration which commonly connects all of the counter electrodes to a panel reference potential point is adopted, and hence the drive circuit is simplified and the power consumption is reduced accordingly. However, it is constructed such that the potential of the counter electrodes is fixed to that at the panel reference potential point and only the applied voltages to the pixel electrodes are controlled over both positive and negative polarities. Therefore, it is required to extend the range of the output voltage of an output stage transistor of the sample/hold circuit in the panel driving IC. This point will be described in detail in the following:

Each of a plurality (same number as the source driving lines) of sample/hold circuits included in the source drive circuit comprises a first circuit part and a second circuit part which alternately carry out the extraction and the holding of voltage sample values of the image signal of each horizontal scanning line in one field and the outputting of the held voltage sample value, where these two circuit parts commonly receive the supply of the image signal and a polarity display pulse of the voltage applied to the LCD cell (polarity display pulse) that is synchronized with the horizontal synchronizing signal of the image signal. The first circuit part includes an AND circuit which generates the logical product output of the horizontal shift pulse and the polarity display pulse, a first sampling switch which samples the image signal voltage in response to the logical product output, a first capacitor which holds the sample value that is the output of the switch, a first buffer amplifier which amplifies the output of the capacitor, and a first output switch which leads the output of the amplifier to the corresponding source driving line. Analogously, the second circuit part includes a NAND circuit which operates complementarily to each of the AND circuit, the first sampling switch, and the output switch, a second sampling switch, and a second output switch, where it is constructed such that the output of the second sampling switch is led, after being hled in a second capacitor, to the source driving line through a second buffer amplifier and the second output switch. In one field period, the first sampling switch is closed for every odd-numbered horizontal scanning line, for example, and the sample value of the image signal voltage is held in the first capacitor. During this period the first output switch stays in the open state, and no driving voltage output is generated from the first circuit part to the source driving line. In contrast, the second output switch of the second circuit part remains closed during this period so that the sampled voltage value held in the second capacitor during the one line in the preceding period is output to the corresponding source driving line through the second buffer amplifier and the second switch. The amplitude of the image signal undergoes polarity inversion for every line in order to prevent the deterioration of the liquid crystal cells, and moreover, the presence or absence of polarity inversion for every line is reversed for every field. By so doing, liquid crystal cells belonging to a certain line which is subjected to the application of a positive polarity image signal during one field period, for example, are arranged to receive without fail the application of a negative polarity image signal during the next field period.

However, in the conventional LCD drive circuit of the above-mentioned type, although the reversion of the presence or absence of polarity inversion of the image signal for every line is implemented for every field or for every frame, the corresponding reversion of the presence or absence of the polarity inversion is not implemented for the polarity display signal of one line length of the horizontal scanning extracted synchronized with the horizontal synchronizing signal of the image signal. In other words, the presence or absence of polarity inversion for one line portion of the image signal and the presence or absence of polarity inversion which is displayed by the polarity display signal could be different. Consequently, the first circuit part of the sample/hold circuit corresponding to a certain pixel electrode of a certain horizontal scanning line, is required not only to carry out the holding and the buffer amplification of the positive sample value upon receipt of an image signal lacking polarity inversion during one field (or frame) period, but also to carry out the holding and the buffer amplification of negative sample value of an image signal upon receipt of supply of image signal with polarity inversion during the next field (or frame) period. An entirely analogous requirement applies also to the second circuit part. Namely, the capacitor for holding the sample value holds sample values of both positive and negative polarities, and correspondingly the range of voltage value that has to be handled is expanded, which requires that the breakdown voltage Of the transistor (FET) of the buffer amplifier has to be raised accordingly.

The process of forming the FET of the buffer amplifier within the LCD driving semiconductor IC includes, when the FET is required to have a high breakdown voltage, two times of diffusion process in order to form a double structure consisting of a heavily doped region and a lightly doped region for each of the source and the drain regions. The dimensional accuracy of the impurity diffused region by these diffusion processes dominates the accuracy of the output voltage of the buffer amplifier. Because of this, the accuracy of the source driving voltage output of the presently commercially available semiconductor IC for LCD driving is about 150 mV at the most. On the other hand, the gradations of images that can be displayed by liquid crystal is improved to about 256 thanks to the improvement of the LCD panel, the CPU of the personal computer, and the like, so it is necessary to enhance the accuracy of the output voltage of the semiconductor IC for driving. This is because the fidelity of the gradation for every pixel of an image to be displayed cannot be ensured for a driving TC which does not satisfy this requirement.

SUMMARY OF THE INVENTION

In accordance with this invention, in a semiconductor integrated circuit device for driving LCD panel which supplies source driving voltages to source driving lines of the LCD panel of the aforementioned configuration, which includes within the semiconductor substrate, means for repeatedly generating cyclic sampling pulses that respectively correspond to the column wiring members, synchronized with the horizontal synchronizing pulse and a clock pulse of predetermined period, means for inverting the polarity of the amplitude value of the image signal with respect to a predetermined reference potential at every generation of the horizontal synchronizing pulse, means for generating a polarity display pulse having a logical level corresponding to the polarity of the output of the polarity inversion means and a sample/hold circuit which scruples the output of the polarity inversion means under the control of the polarity display pulse and the sampling pulse and, after holding the sampled values for the one line period of the horizontal scanning, supplies then to the column wiring members, there is obtained a semiconductor integrated circuit device for driving LCD panel which is characterized in that the sample/hold circuit has a first circuit part which carries out the sampling and the sample value holding in one of the one-line periods of the horizontal scanning, and a second circuit part which carries out the sampling and the sample value holding in the next one of the one-line periods, and the correspondence relation between the polarity of the outputs of the first and second circuit parts and the polarity inversion means is kept invariant.

Moreover, in accordance with this invention there can be obtained a semiconductor circuit device for driving LCD panel which can achieve the formation of the source and the drain regions of the input transistor of the buffer amplifier of the sample/hold circuit in the semiconductor substrate in just one time of impurity diffusion process.

BRIEF DESCRIPTION OF THE DRAWINGS

The above-mentioned and other objects, features and advantages of this invention will become more apparent by reference to the following detailed description of the invention taken in conjunction with the accompanying drawings, wherein.

DETAILED DESCRIPTION OF THE PREFERRED EMBODIMENT

Figure 1:
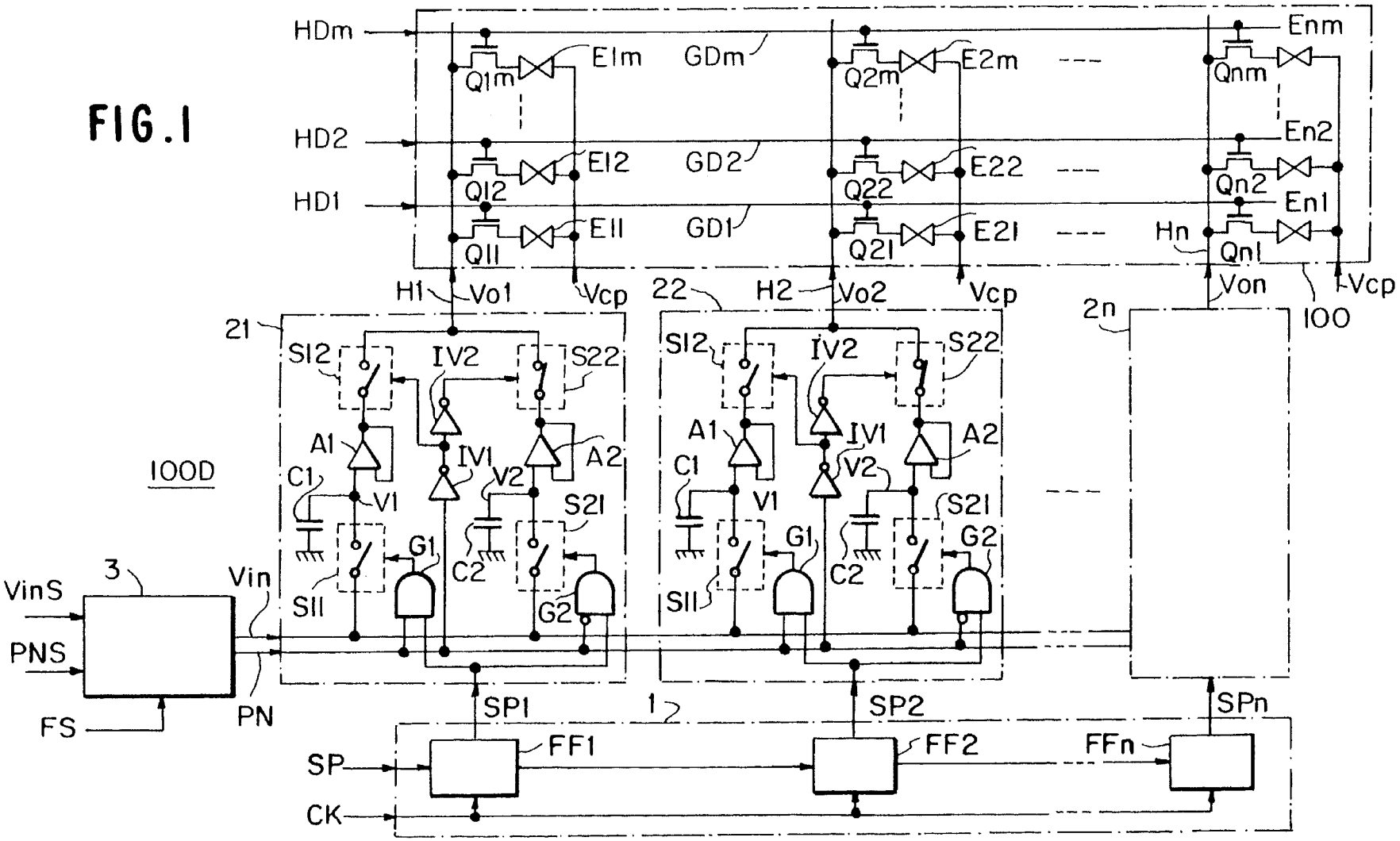
FIG. 1 is a circuit diagram for an embodiment of the invention.

Referring to FIG. 1, an LCD driving IC 100D according to an embodiment of the invention supplies voltage sample value outputs of image signal Vo1, Vo2, . . . , and Von to source driving lines H1, H2, . . . , and Hn of an LCD panel 100 which comprises liquid crystal cells E11, E21, . . . , En1, E12, R22, . . . , En2, . . . , Eij, . . . , Eim, . . . , and Enm that are arrayed in matrix form in both directions of row and column, gate driving line GD1, GD2, . . . , and GDm formed mutually parallel between the array in the row direction of these liquid crystal cells Eij (i=1 to n and j=1 to m, and similarly hereinafter), source driving lines H1, H2, . . . , and Hn formed mutually parallel between the array in the column direction of the liquid crystal cells Eij, and switching FETs Q11, Q21 . . . , Qn1, Q12, Q22, . . . , Qn2, . . . , Qij, . . . , Qlm, . . . , and Qnm arranged at various noncontact intersections of these driving lines, where the gate electrode of each FET is connected to the gate driving line, its source electrode is connected to the source driving line, and its drain electrode is connected to the pixel electrode of the liquid crystal cell. Gate driving voltages HD1, HD2, . . . , and HDm for. vertical scanning are supplied from a gate drive circuit which is not shown to the gate driving lines GD1, GD2, . . . , and GDm of the LCD panel 100. In addition, each of the counter electrodes of the liquid crystal cells Eij is Commonly connected by a common wiring member (not shown) formed in parallel to the source driving lines H1, H2, . . . , and Hn, and is maintained at a panel reference potential Vcp (for example, a potential which is nearly at the middle of the power supply potential on the low potential side and the power supply potential on the high potential side).

Referring also to FIG, 1, the IC100D includes a shift register 1 which generates horizontal shift pulses SP1, SP2, . . . , and SPn corresponding to the sample value outputs Vo1, Vo2, . . . , and Yon in response to a clock pulse CK and start pulse SP, a level/polarity control circuit 3 which generates an image signal voltage Vin with controlled amplitude level/polarity and an accompanying polarity display pulse PN upon receipt of an image signal to be displayed VinS, an accompanying polarity display signal PNS, and a synchronizing signal FS, and sample/hold circuits 21, 22, . . . , and 2n which generate respectively the sample value outputs Vo1, Vo2, . . . , and Von upon common receipt of the signal voltage Vin and the pulse PN from the control circuit 3 and upon separate receipt of the horizontal shift pulses SP1, SP2, . . . , and SPn. The shift register 1 consists of n-stage flip-flop circuits FF1, FF2, . . . , and FFn that are mutually cascade connected and receive the clock pulse, and generate the horizontal pulses SP1, PS2, . . . , and SPn which define one line of the horizontal scanning, triggered by the start pulse SP to the first stage circuit FF1 synchronized with the horizontal synchronizing signal of the image signal VinS.

The sample/hold circuit 21 which is one of sample/hold circuits 21, 22, . . . , and 2n that have mutually common structure, comprises a first circuit part that has an AND circuit G1 which generates the AND output of the polarity display pulse PN and the horizontal shift pulse SP1, a first sampling switch S11 which is energized in response to the output of the circuit G1 and samples the image signal voltage Vin, a first capacitor C1 which holds the output voltage of the switch S11, a first buffer amplifier A1 which amplifies the output of the capacitor C1, and a first output switch which selectively leads the output of the amplifier A1 to the source driving line H1, a second circuit part that has a AND circuit G2 which generates the AND output of the polarity display pulse PN and the horizontal shift pulse SP1, a second sampling switch S21 which goes to energized state in response to the output of the circuit G2 and samples the image signal vin, a second capacitor which holds the output of the switch S21, a second buffer amplifier which amplifies the output of the capacitor C2, and a second output switch S22 which leads selectively the output of the source driving line H1, an inverter IV1 which supplies the polarity inverted output of the polarity display pulse PN to the first output switch S12 so as to complementarily drive the first and the second output switches of the first and second circuit parts, and another inverter IV2 which supplies the polarity inverted output of the output of the first inverter IV1.

Figure 4:
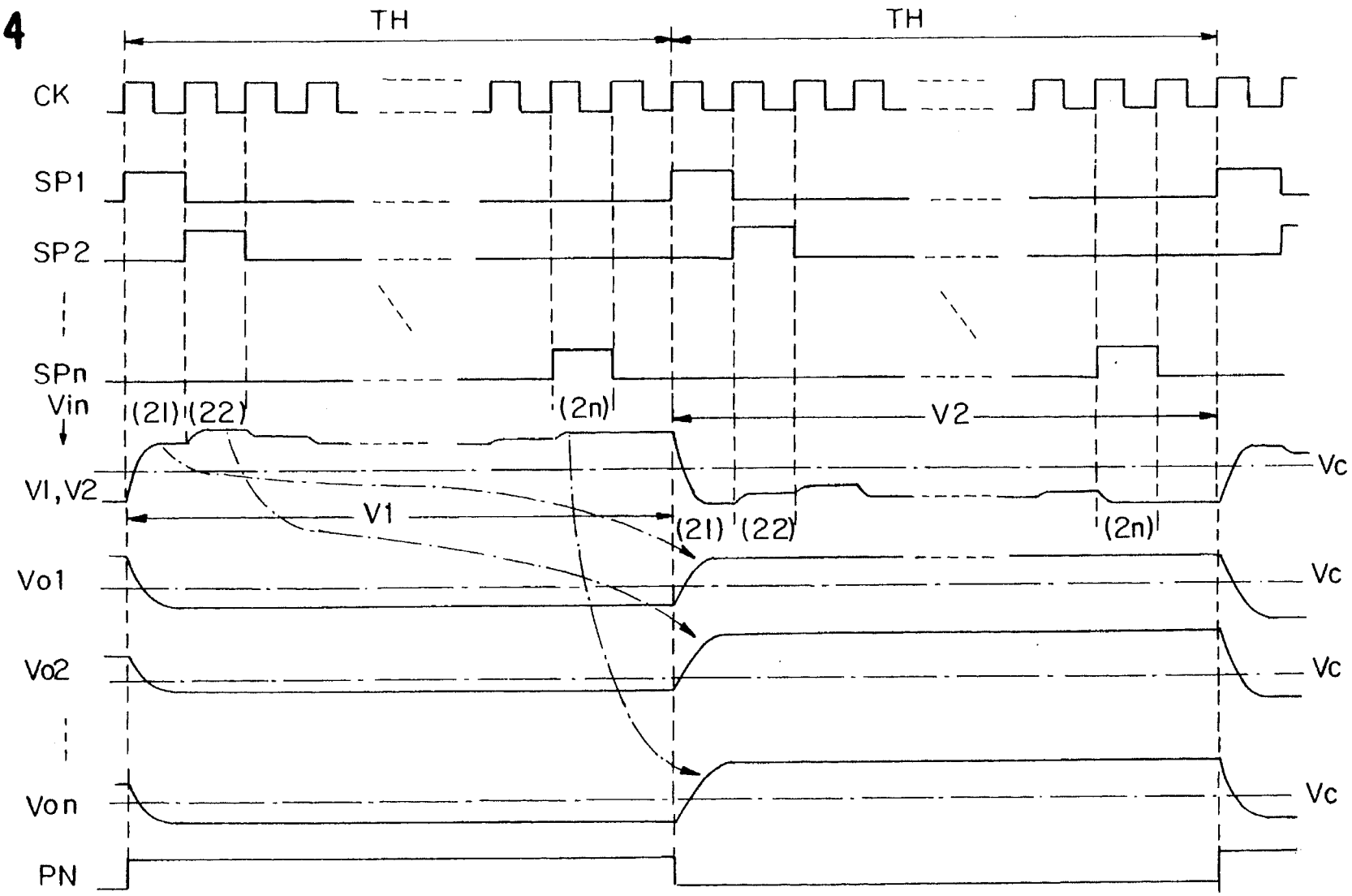
FIG. 4 is a signal waveform diagram for various parts of the embodiment.

Referring further to FIG. 4, the image signal Vin has inverted polarity for every period TH of the horizontal scanning line in order to give polarity inversion for every line of the applied voltage to the liquid crystal cell. Namely, the polarity of the signal voltage Vin repeats inversion with respect to the center voltage Vc corresponding to the panel reference voltage Vcp, synchronized with the horizontal synchronizing signal of the image signal, and the polarity display pulse PN that accompanies the voltage Vin takes on a high (H) or low (L) value synchronized with the polarity inversion. In this embodiment the control circuit 3 is constructed such that the pulse PN takes on H level when the polarity of Vin is positive, and L level when it is negative. The control circuit 3 which generates the signal voltage and the polarity display pulse PN by receiving the supply the input image signal VinS, the polarity display signal PNS, and the frame synchronizing signal FS may be constructed by a semiconductor chip separate from the LCD driving IC 100D. In any case, detailed description of the circuit 3 with such configuration will not be given since it is obvious to persons skilled in the art. Further, when the LCD panel 100D is of large scale and the number of the source driving lines H1 to Hn is large, two driving ICs 100DA and 100DB may be assigned to the panel 100D. In that case, it is possible, during the period of an odd-numbered field of the image signal, to let one of the panels, IC100DA, supply the sample value outputs Vo1 to Von to an odd-numbered horizontal scanning line (corresponding to one line portion of the gate driving lines) and let the other panel 100DB supply the sample value outputs Vo1 to Von to an even-numbered horizontal scanning line, and during the period of an even-numbered field, the relation between the ICs of supply source of the sample value outputs and odd-/even-numbered lines is reversed with respect to the relation described in the above.

Since the polarity of the signal voltage Vin and the level (H or L) of the polarity display pulse PN maintains the above-mentioned relation as is also indicated in FIG. 4, when the AND gate G1 of the first circuit part of the sample/hold circuit 21 receives the horizontal shift pulse SP1 and a polarity display pulse PN of H level, the positive polarity value of the signal voltage Vin is sampled by the switch S11, and the sampled value is stored in the capacitor C1. Since the output switch S12 is in deenergized state at this time, the sampled value remains held in the capacitor C1. Since the second output switch is in energized state at this time, the terminal voltage of the capacitor C2, that is, the sample value of the signal voltage Vin for one line earlier, is supplied to the source driving- line H1 through the buffer amplifier A2 and the switch S22.

Moving to the period of the next horizontal scanning line, since the signal voltage Vin goes to negative polarity and the polarity display pulse PN goes also to L level, the AND output of the AND circuit G1 goes to L level and the NAND output of the AND circuit goes to H level. In response to this the second sampling switch S21 samples the negative polarity voltage Vin, and the sampled value is held in the capacitor C2. Since the second output switch S22 is in deenergized state at this time, the sampled value remains held in the capacitor C2. On the other hand, since the first output switch is in energized state at this time, the terminal voltage of the first capacitor is supplied through the switch S12 to the source driving line H1 after being amplified by the buffer amplifier A1.

When in moves to the subsequent horizontal scanning line, the sample value of the signal voltage Vin is supplied to the source driving line H1 by the complementary operation of the switches S11/S12 and S21/S22. The sample value train Vo1 from the sample/hold circuit 21 to the source driving line H1 is generated as described in the above. The above description is also applicable to the ensuing sample value trains Vo2 to Von generated by the sample/hold circuits 22 to 2*n*. Therefore, the time interval portions corresponding to the horizontal shift pulse trains SP1, SP2, . . . , and SPn of the signal voltage Vin in FIG. 4 are represented by the reference numerals (21), (22), . . . , and (2*n*), and further description is omitted.

Figure 2:
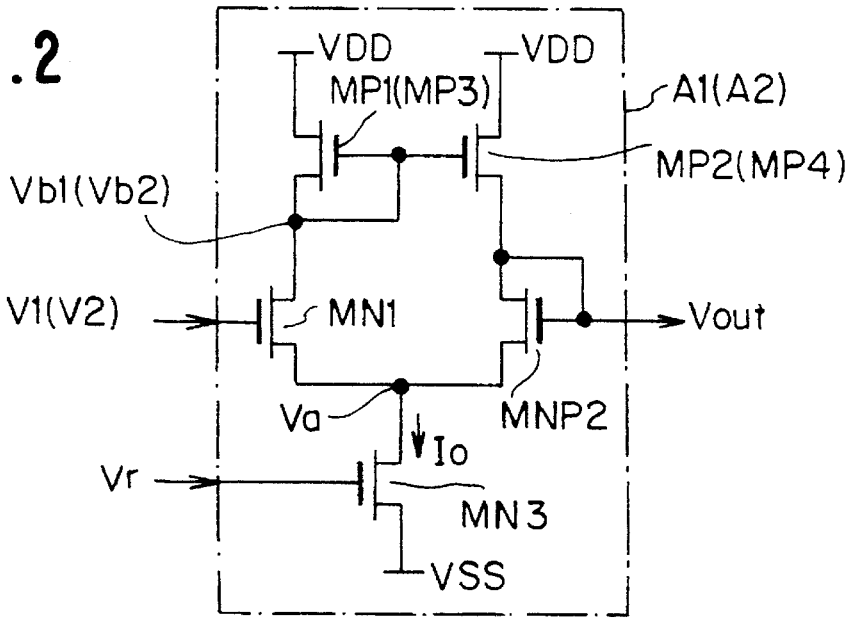
FIG. 2 is a circuit diagram for the buffer amplifier constituting a part of the embodiment.

Referring to FIG. 2 showing an example of specific circuit construction of each of the buffer amplifiers A1 and A2, the buffer amplifier A1 [or A2. In the following explanation of the configuration, remark within [] applies to A2, and when no [] mark appears, statement applies commonly to both.] comprises an N-channel input transistor MN1 which receives the terminal voltage V1 [terminal voltage V2 of the capacitor C2], an N-channel input transistor MN2 with identical composition to the input transistor MN1, having its gate electrode and the drain electrode connected to the input terminal of the output switch S12 [S22] and its source electrode connected to the source electrode of the transistor MN1, an N-channel transistor for constant current source which receives a current source reference voltage Vr at its gate electrode and has its source electrode connected to the supply terminal of power supply voltage VSS on the low potential side and its drain electrode connected to the respective source electrodes of the input transistors MN1 and MN2, a P-channel voltage setting transistor MP1 ]MP3] which has its gate electrode and the drain electrode connected to the drain electrode of the input transistor MN1 and its source electrode connected to the supply terminal of the power supply voltage VDD on the high potential side, and keeps the drain electrode of the input transistor at voltage Vb1 [Vb2], and a load transistor MP2 [MP4] with the same configuration and the same conductivity type as those of the transistor MP1 [MP3], having its gate electrode connected to the gate electrode and the drain electrode of the transistor MP1 [MP3], its source electrode connected to the supply terminal of the power supply voltage VDD on the high potential side, its drain electrode connected to the drain electrode and the gate electrode of the input transistor MN2, and forms a current mirror together with the transistor MP1 [MP3].

Figure 3A:
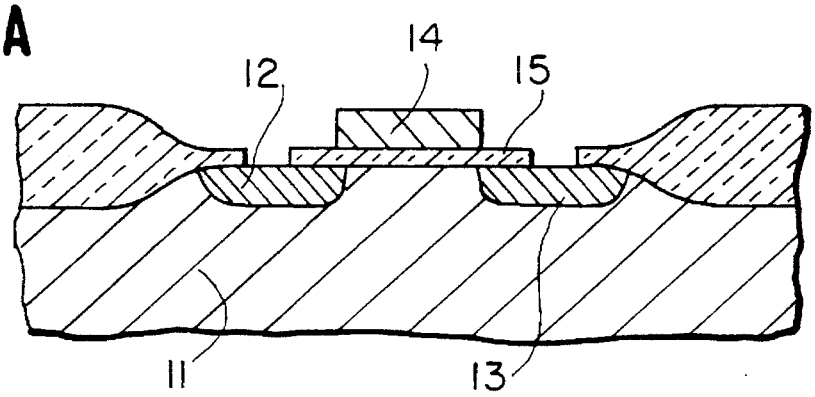
FIGS. 3(*a*) and 3(*b*) show sectional diagrams of the FET constituting a part of the buffer amplifier.

In the buffer amplifier A1 [A2], the N-channel input transistors MN1 and MN2 are the so-called single structure FETs which include a source region 12 and a drain region 13 formed respectively by high concentration impurity diffusion, as shown by the sectional diagram in FIG. 3(A) , having no region of low impurity concentration in the periphery of the source region 12 and the drain region 13. Therefore, the breakdown voltage between the source and the drain is increased accordingly. Since, however, the relation between the polarity of the signal voltage Vin and the logical level of the polarity display pulse is fixed as described in the above and since the positive sample values of the voltage Vin are held in the first capacitor C1 and its-negative sample values are held in the second capacitor C2, the above-mentioned drop in the breakdown voltage gives no adverse effect on the operation of the buffer amplifier [A2]. In other words, since the polarity of the terminal voltage of the first capacitor C1 remains positive without going to negative, the breakdown voltage between the source and the drain of the input transistors MN1 and MN2 is reduced accordingly. Accompanying the reduction of the required breakdown voltage, the low concentration impurity region for increasing the breakdown voltage becomes unnecessary so that the fabrication process is that much simplified. Moreover, these transistors have a single structure as mentioned in the above, so it is casier to control the variance in the channel length, channel width, threshold voltage, and the like.

Figure 3B:
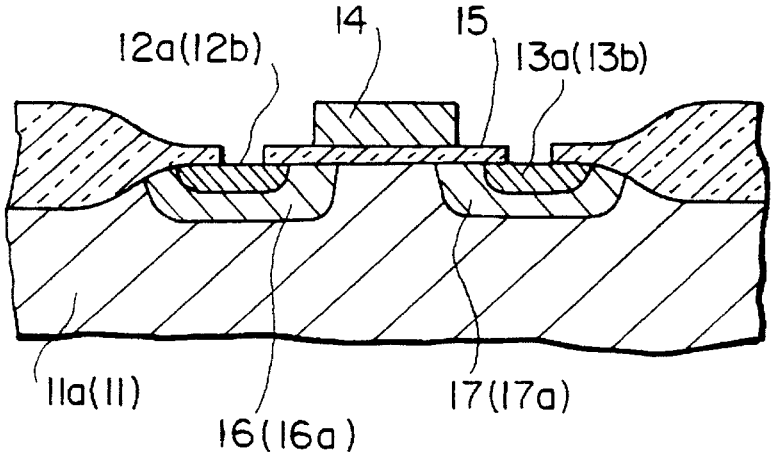

On the other hand, the voltage setting P-channel transistor MP1 [MP2] has low concentration impurity regions 16 [16*a*] and 17 [17*a*] in the periphery of a source region 12*a* [12*b*] and a drain region 13*a* [13*b*] formed by high concentration impurity diffusion as shown by the sectional diagram in FIG. 3(B) , and possesses the so-called double structure by which the breakdown voltage between the source and the drain is enhanced. Although the double structure is indispensible for securing the breakdown voltage, the precision for the channel length, channel width, and the like required for the voltage setting is markedly lower than that for the input transistors MN1 and MN2, so that it will not introduce special difficulty in the fabrication process.

Figure 5A:
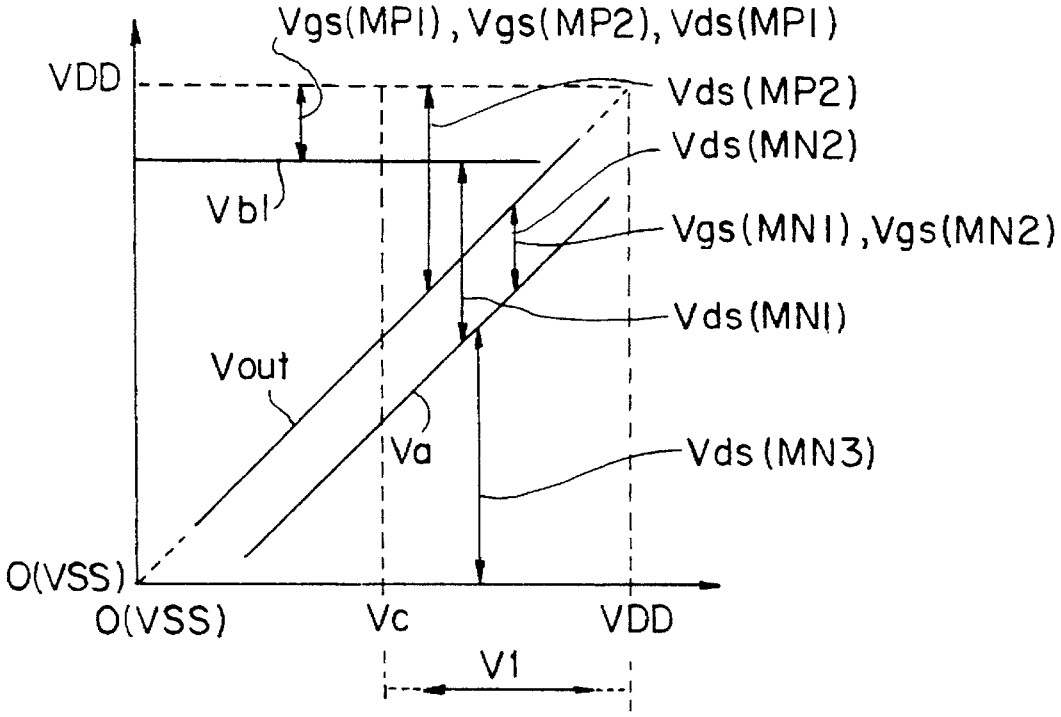
FIGS. 5(*a*) and 5(*b*) are operating characteristic diagrams of the buffer amplifier.
Figure 5B:
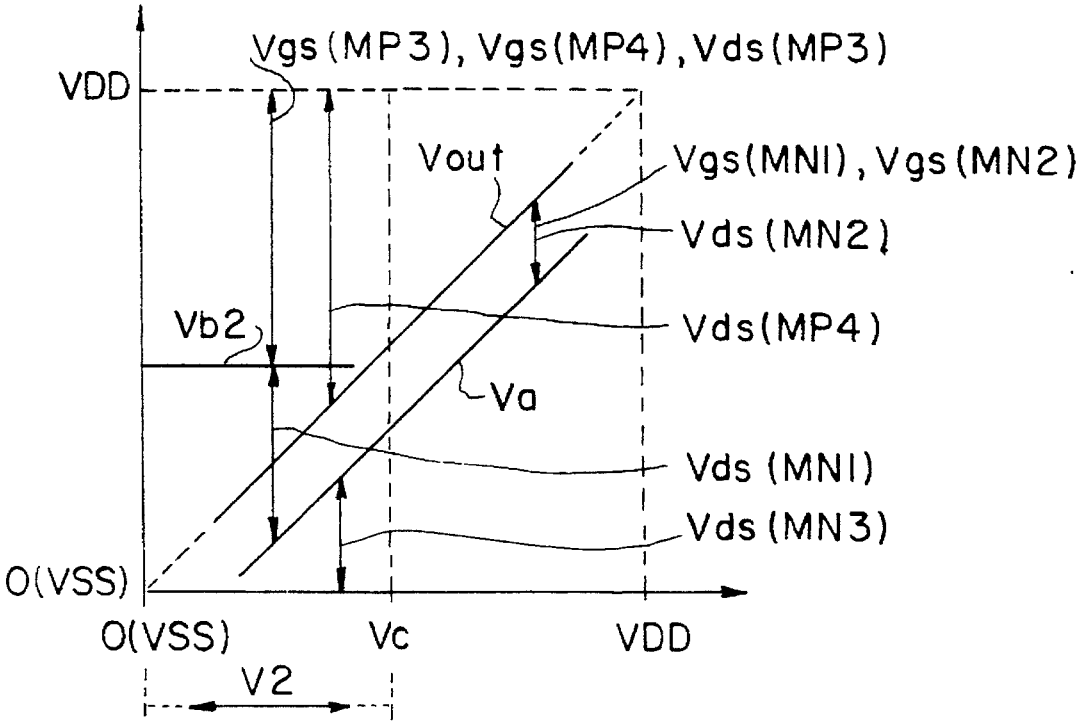
Figure 6:
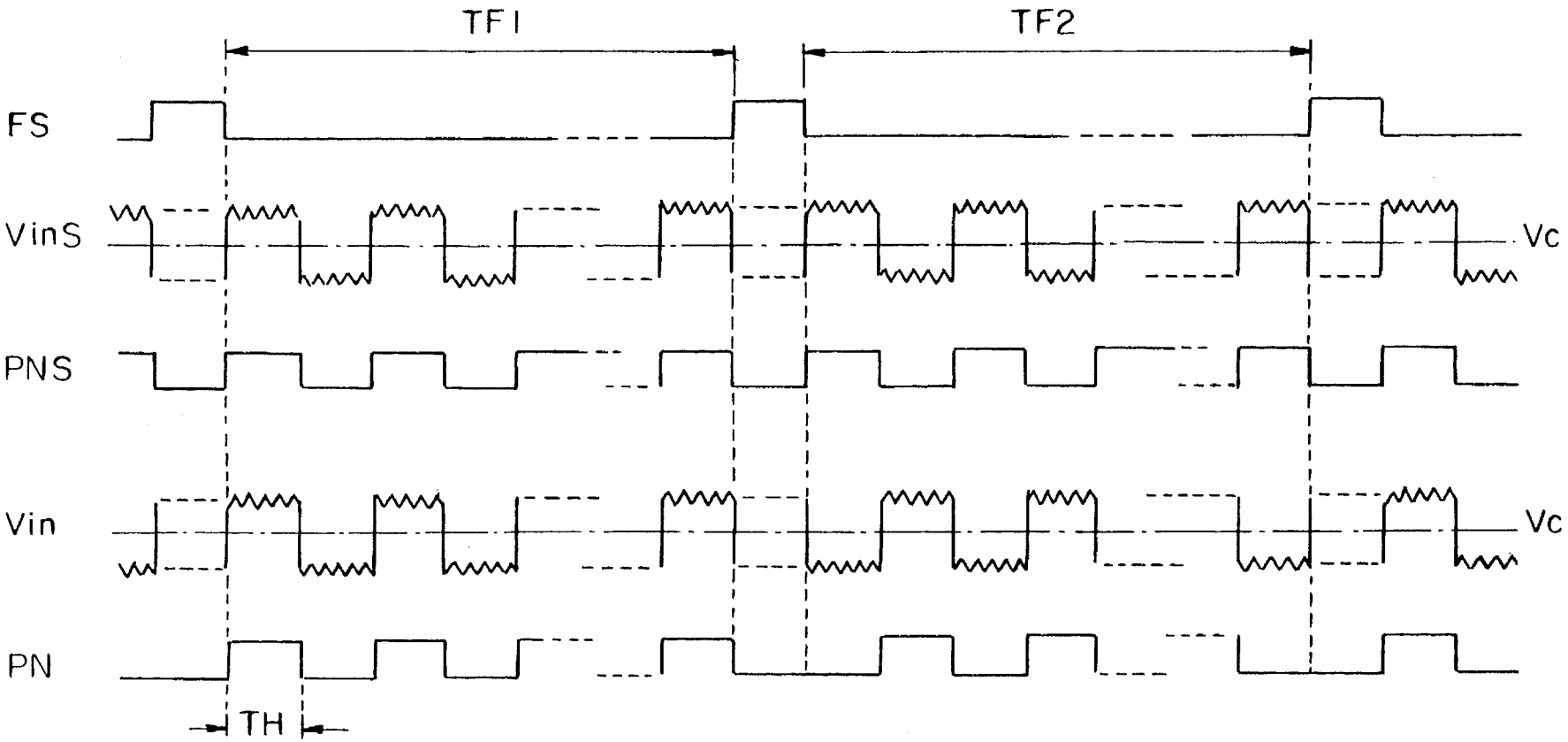
FIG. 6 is a signal waveform diagram for explaining the overall operation of the embodiment.

Referring also to FIGS. 5(A) and 5(B) which show the operating characteristics of the buffer amplifiers A1 and A2 that correspond respectively to the positive polarity and the negative polarity of the signal voltage Vin, the operation of these amplifiers A1 and A2 and the influence of their operation on the components will be described in more detail.

Since the reference voltage Vr is applied to the gate electrode of the constant current source transistor MN3, a constant current Io flows in the transistor MN3. If one assumes that the transistor MP1 [MP3] and the transistor MP2 MP4 have identical configuration and identical dimensions, then equal current Io/2 flows in MN1, MP1 [MP3] and MN2, MP2 [MP4]. Accordingly, the voltages between the gate and the source Vgs(MP1) and Vgs(MP2) [Vgs(MP3) and Vgs(MP4)] of the transistors MP1 and MP2 [MP3 and MP4] are equal and constant. In addition, if one assumes that the transistors MN1 and MN2 have identical configuration and identical dimensions, then the gate-source voltages Vgs(MN1) and Vgs(MN2) of these transistors become also equal and constant. Since the gate electrode and the drain electrode of the transistor MP1 [MP3] and the drain electrode of the transistor MN1 are connected, the voltage Vb1 [Vb2] of the transistors MP1 [MP3] and MN1 is a constant voltage equal to Vgs(MP1) [Vgs(MP3)].

On the other hand, since the gate electrode and the drain electrode of the transistor MN2 are connected to the drain electrode of the transistor MP2 [MP4], the buffer amplifier A1 [A2 ] acts as a feedback type differential amplifier, and the output voltage Vout of this differential amplifier becomes nearly equal to the input voltage (gate voltage Vg(MN1) of the transistor MN1).

Consequently, voltage Va of ,the source electrode of the transistors MN1 and MN2 has a characteristic which is shifted by a constant voltage from the output voltage Vout, and the difference between the voltage Va and the output voltage Vout becomes the gate-source voltages Vgs(MN1) and Vgs(MN2) and drain-source voltage Vds(MN2) of the transistor MN2. Further, the difference between the voltage va and the voltage Vb1 [Vb2] becomes the drain-source voltage Vds(MN1) of the transistor MN1, the difference between the voltage Va and the power supply voltage on the low potential side VSS (0 V in FIG. 5) becomes drain-source voltage Vds (MN3) of the transistor MN3, the difference between the voltage Vb1 [Vb2] and the power supply voltage on the high potential side VDD becomes the drain-source voltage Vds(MP1) [Vds(MP3)] of the transistor MP1 [MP3], and the difference between the output voltage Vout and the power supply voltage on the high potential side VDD becomes drain-source voltage Vds(MP2) [Vds(MP4)] of the transistor MP2 [MP4].

On the other hand, since the input voltage of the buffer amplifier A1 [A2] that is terminal voltage V1 V2 of the capacitor C1 [C2], undergoes a level shift (smaller than VDD [greater than VSS]) on the high [low] potential side with respect to the center potential Vc, by setting the voltage Vb1 [Vb2] of the drain electrode of the input transistor at a voltage (voltage comparable to the center potential Vc) slightly lower with respect to the power supply voltage on the high potential side VDD, it is possible to suppress the drain-source voltage Vds(MN1) of the transistor MN1 to below about (VDD-VSS)/2 (in FIG. 5 it is about VDD/2 since VSS=0).

Moreover, the drain-source voltage vds (MN2) of the input transistor MN2 which forms a differential transistor pair together with the transistor MN1 is equal to the gate-source voltage vgs(MN2) of this transistor MN2 itself, and is naturally smaller than VDD/2. Accordingly, the drain-source breakdown voltage of the input transistors MN1 and MN2 of the buffer amplifier A1 [A2] can be suppressed to a low value of about VDD/2, and hence it is possible to form these input transistors MN1 and MN2 in a low breakdown voltage type of single structure as shown in FIG. 3(A).

For the prior art LCD driving IC in which the polarity of the terminal voltage of the capacitor C1 could be negative, it is necessary to enhance the source-drain , breakdown voltage of the input transistors MN1 and MN2 by giving them a double structure. In that case, it becomes necessary to give two times of impurity diffusion process in order to form high concentration impurity regions and low concentration impurity regions for the drain regions and the source regions as mentioned before. This increases the factors of the variance concerning the fabrication process and the structure which widens the variance spread of the voltage threshold of the transistors MN1 and MN2. Accompanying this, the accuracy of the output voltage of the buffer amplifiers A1 and A2 is decreased, and reduces the fidelity of the output sample value Vo1 to the sample value of the input signal voltage Vin, spoiling the quality of the display image.

In contrast to this, it is possible in this invention to give a single structure to the input transistors MN1 and MN2 as mentioned above, so the fabricational and the structural factors of variance can be reduced, and accompanying this the spread of the variance of the threshold of the transistors MN1 and MN2 can be made small. As a result, the accuracy of the output voltage of the buffer amplifiers A1 and A2 is improved. Therefore, the quality of the display image can be improved accordingly.

It should be noted that the voltage Vb1 [Vb2] of the drain-electrode of the input transistor MN1 can be set at a desired value by the selection of the dimensions of the voltage setting transistor MP1 [MP3].

Referring to PIG. 6 which is a signal waveform diagram for describing the function of the control circuit 3 in the above embodiment, the polarities of the input signal VinS and the polarity display signal PNS are kept as they are in the polarities of the signal voltage Vin and the polarity display pulse PN, respectively, in the period TF1 of a first field. However, in the period TF2 of a second field in which the presence or absence of polarity inversion for each one line of the signal voltage Vim is reversed, the relation between the H/L levels and the odd-/even-numbered lines is reversed, and hence the relation between the polarity of the signal voltage vim and the H/L level of the pulse PN is made to agree. The waveform of each signal during the period TF3 of a third field ensuing the period TF2, namely, the period (not shown) of the first field of the next frame, is the same as that of the period TF1, and a similar polarity inversion is repeated thereafter.

Although the invention has been described with reference to a specific embodiment, this description is not meant to be construed in a limiting sense. Various modifications of the disclosed embodiment, as well as other embodiments of the invention, will become apparent to persons skilled in the art upon reference to the description of the invention. It is therefore contemplated that appended claims will cover any modifications or embodiments as fall within the true scope of the invention.

We claim:

1. In a semiconductor integrated circuit for driving a liquid crystal display (LCD) panel which includes a plurality of pixel formation electrodes arranged in matrix array forming a plurality of rows and columns on one surface of a transparent and plate like first base material, a plurality of counter electrodes arranged at respective positions corresponding respectively to said pixel formation electrodes on the surface opposite to said first base material of a second base material arranged in a surface parallel to said first base material with a minute gap between the first base material, a liquid crystal material filling said minute gap to form liquid crystal cells together with said pixel formation electrodes and the corresponding counter electrodes, a plurality of row wiring members formed respectively between said rows of said pixel formation electrodes in parallel to these rows, a plurality of column wiring members formed respectively between said columns of said pixel formation electrodes in parallel to and in noncontact state with these column wiring members, and a thin film transistor (TFT) which is arranged at each of the intersections of these row wiring members and the column wiring members with its gate electrode connected to said row wiring member and its source electrode connected to said column wiring member and its drain electrode connected to said pixel formation electrode, energized in response to a gate driving voltage from said row wiring member to supply a source driving voltage from said column wiring member to said pixel formation electrode and selectively controls the light transmission characteristic of said liquid crystal cell corresponding to the pixed formation electrode, thereby said source driving voltage is supplied to said column wiring member of the TFT-base LCD panel in which an image for one line portion of the horizontal scanning of the image signal to be displayed is displayed in said liquid crystal cells belonging to one line of said row wiring member, the semiconductor integrated circuit device for LCD panel driving which includes within a semiconductor substrate, means for repetitiously generating sampling pulses cyclically corresponding respectively to said column wiring members synchronized with the horizontal synchronizing pulse of said image signal and a clock pulse of a predetermined period, means for inverting the polarity of the amplitude of said image signal with respect to a predetermined reference potential every time when said horizontal synchronizing pulse is generated, means for generating a polarity display pulse having logical level corresponding to said polarity of the output of said polarity inversion means, and a sample/hold circuit which samples the output of said polarity inversion means under control of said polarity display pulse and said sampling pulse and supplies the sample values to said column wiring members after holding them for the period of one line of said horizontal scanning, the semiconductor integrated circuit device for LCD panel driving characterized in that said sample/hold circuit has a first circuit part which performs said sampling and said sample value holding in one of one-line period of said horizontal scanning and a second circuit part which performs said sampling and said sample value holding in one period of the next one line, and the correspondence relation of the first and the second circuit parts and said polarity of the output of said polarity inversion means is kept invariant, wherein each of said first circuit parts of said sample/hold circuit includes an AND circuit for generating the AND output of said polarity display pulse and said sampling pulse, a first sampling switch which is energized in response to the output of this AND output for sampling the output voltage of said polarity inversion means, a first capacitor for holding the output voltage of this sampling switch, a first buffer amplifier for amplifying the terminal voltage of this capacitor, a first output switch for selectively supplying the output of amplifier to corresponding said column wiring member, said second circuit part includes an AND circuit for generating the AND output of said polarity display pulse and said sampling pulse, a second sampling switch for sampling the output voltage of said polarity inversion means in response to this AND output, a second capacitor for holding the output voltage of this sampling switch, a second buffer amplifier provided independently of said first buffer amplifier for amplifying the terminal voltage of this capacitor, and a second switch for selectively supplying the output of this amplifier to corresponding one of said column wiring members, and said sample/hold circuit further includes means for complementarily bringing said first sampling switch and said first output switch, and said second sampling switch and said second output switch to energized state by means of said polarity display pulse, the voltage held by said first capacitor is always one of negative and positive polarities and the voltage held by said second capacitor is always the other of said negative and positive polarities, so that said first capacitor is free from holding the voltage of said other of said negative and positive polarities, and said second capacitor is free from holding the voltage of said one of said negative and positive polarities.

2. A semiconductor integrated circuit device for LCD panel driving as claimed in claim 1, wherein said polarity display pulse generating means inverts the output logical level for every period of the field or the frame of said image signal to maintain the correspondence relation with said polarity of the output of said polarity inversion means.

3. A semiconductor antegrated circuit device for LCD panel driving as claimed in claim 1, wherein said sample/hold circuits are provided in one-to-one correspondence to said column wiring members.

4. A semiconductor integrated circuit device for LCD panel driving as claimed in claim 1, wherein said polarity inversion means and said polarity display pulse generating means are formed in a semiconductor chap separate from that for other components and further includes means for connection to this separate semiconductor chip.

5. A semiconductor integrated circuit device for LCD panel driving as claimed in claim 1, wherein the process of forming the source and the drain regions within said semiconductor substrate for each transistor of said first and said second buffer amplifiers can be accomplished in one operation of impurity diffusion process.

6. A semiconductor integrated circuit device for driving a liquid crystal display device having a plurality of device lines each supplied with a drive voltage relative to an image signal to be displayed, said image signal having a sequence of fields, said semiconductor integrated circuit device comprising producing means responsive to said image signal for producing a first signal every odd-numbered field of said sequence of fields and a second signal every even-numbered field of said sequence of fields, said first signal always having a first polarity and said second signal always having a second polarity opposite to said first polarity, and a plurality of drive circuits each coupled to an associated one of said drive lines of said liquid crystal display device to supply said drive voltage thereto, each of said drive circuits including first circuit means coupled to said producing means for sampling and holding said first signal, second circuit means coupled to said producing means for sampling and holding said second signal, said first circuit means being free from sampling and holding said second signal and said second circuit means being free from sampling and holding said first signal, a first buffer amplifier coupled to said first circuit means to amplify the first signal sampled and held by said first circuit means, a second buffer amplifier coupled to said second circuit means and provided independently of said first buffer amplifier to amplify the second signal sampled and held by said second circuit means, and third circuit means coupled to said first and second buffer amplifiers for producing said drive voltage by alternately outputting output voltages of said first and second buffer amplifiers.

7. The device as claimed in claim 6, wherein each of said first and second circuit means includes a capacitor for holding an associated one of said first and second signals.

8. The device as claimed in claim 7, wherein said producing means produces said first and second signals alternately and said third circuit means outputs the output voltage of said first buffer amplifier when said producing means is producing said second signal and the output voltage of said second buffer amplifier when said producing means is producing said first signal.

* * * * *

UNITED STATES PATENT AND TRADEMARK OFFICE

CERTIFICATE OF CORRECTION

PATENT NO. : 5,526,014
DATED : June 11, 1996
INVENTOR(S) : Hiroshi SHIBA, et al.

It is certified that error(s) appears in the above-identified patent and that said Letters Patent is hereby corrected as shown below:

Column 4, line 50, delete "scruples" and insert --samples--.

Column 5, line 63 delete "Yon" and insert --Von--.

Column 7, line 17, after "switch" insert --S22--.

Column 8, line 32, after "amplifier" insert --A1--.
Column 10, line 26, "Pig" should read --Fig.--.
Column 10, line 35, delete "Vim" and insert --Vin--;
line 37, delete "vim" and insert --Vin--.

Column 12, line 35, delete "chap" and insert --chip--.

Signed and Sealed this

Twenty-sixth Day of November 1996

*Attest:*

BRUCE LEHMAN

*Attesting Officer*

*Commissioner of Patents and Trademarks*